US008226503B2

(12) United States Patent
Rusch et al.

(10) Patent No.: US 8,226,503 B2
(45) Date of Patent: Jul. 24, 2012

(54) FOOTBALL BLOCKING SIMULATION APPARATUS

(75) Inventors: Craig Arthur Rusch, Hilbert, WI (US); Britt Corso Mork, Lemont, IL (US); Chris Newquist, Sycamore, IL (US)

(73) Assignee: Northern Illinois University, DeKalb, IL (US)

( * ) Notice: Subject to any disclaimer, the term of this patent is extended or adjusted under 35 U.S.C. 154(b) by 0 days.

(21) Appl. No.: 12/767,849

(22) Filed: Apr. 27, 2010

(65) Prior Publication Data

US 2011/0263354 A1 Oct. 27, 2011

(51) Int. Cl.
*A63B 69/34* (2006.01)

(52) U.S. Cl. ..... 473/445; 473/422; 473/441

(58) Field of Classification Search ..... 473/441, 473/442, 444, 422, 445; 482/8, 9, 54; 434/251
See application file for complete search history.

(56) References Cited

U.S. PATENT DOCUMENTS

| | | | | |
|---|---|---|---|---|
| 3,467,380 | A * | 9/1969 | Bonacci | 473/439 |
| 3,997,160 | A * | 12/1976 | George | 473/444 |
| 6,458,051 | B1 * | 10/2002 | Moore | 473/445 |
| 7,527,568 | B2 * | 5/2009 | Joseph | 473/441 |
| 7,736,248 | B2 * | 6/2010 | Eldridge | 473/445 |

* cited by examiner

*Primary Examiner* — Mitra Aryanpour
(74) *Attorney, Agent, or Firm* — Kohn & Associates, PLLC

(57) ABSTRACT

According to the present invention, there is provided a sports training apparatus for accurately simulating the football maneuver known as the 'cut-block.' The present invention comprises a track, a rolling cart fitted to the track, an upright blocking pillar connected to the cart, and a triggering system for lowering and raising the blocking pillar at specified intervals in order to simulate the cut-block maneuver. The present invention additionally includes a stopping mechanism for stopping the movement of the cart.

9 Claims, 8 Drawing Sheets

FOOTBALL BLOCKING SIMULATION APPARATUS

BACKGROUND OF THE INVENTION

1. Field of the Invention

The present invention generally relates to the field of sports simulation and training equipment. More specifically, the present invention generally relates to a training device for simulating the football maneuver commonly known as the 'cut-block.'

2. Description of Related Art

In the game of football, one of the most difficult blocks a lineman encounters is the infamous cut-block. A cut-block is a technique wherein an offensive player dives at the knees and ankles of a defensive player in an attempt to slow the defensive player down, knock him off path, or to simply get the defender's hands down to allow for a quick pass to be thrown over the defender's head. A cut-block is most commonly executed against defensive linemen as the defensive lineman is running towards an offensive lineman. As the two linemen approach one another, face to face, the offensive player suddenly dives down towards the defender's legs in attempt to impede the defender's progress. Conventional football wisdom dictates that when faced with a cut-block, the defender should bring his hands down upon the offensive player's helmet and shoulder pads while the defender also kicks his outside leg back to prevent the offensive player from knocking his legs out from underneath him. This technique aims to allow the defender to remain on his feet with the ability to regain his defensive stance as quickly as possible.

One reason why the cut-block is so effective is its element of surprise. The defensive player can generally not predict if or when an offensive player will attempt a cut-block. Because of this, once a defensive player has fallen victim to a cut-block, the defensive player may play more cautiously, not wanting to get cut again.

Another reason that the cut-block is so effective is that it is very difficult for players to safely practice. Especially difficult is attempting to incorporate the element of surprise inherent in a cut-block. Furthermore, since the cut-block can cause injury, most football teams very rarely practice the block, so as to not injure their own personnel. While certain techniques have been developed in attempt to simulate a cut-block, these techniques are generally found to be unrealistic when compared to an actual cut-block.

Currently, several tools exist which endeavor to simulate the cut-block. One such item is essentially a large medicine ball, approximately 36 inches in diameter and weighing 75 pounds. The ball is used to simulate a cut-block by rolling it at a defensive player. The player is expected to stop the ball with his hands and kick back his outside leg. The problem with using such a medicine ball to simulate a cut-block is that it is not a very realistic simulation. Firstly, the medicine ball cannot simulate the element of surprise inherent in the cut-block, as the defender can see the ball coming towards him. Secondly, the medicine ball is also an inaccurate simulation in that the defender is not fully engaged with the offender retreating as is usually the case in an actual cut-block scenario. Other approaches to simulating a cut-block include throwing smaller balls towards a defensive players feet, however these methods possess many of the same shortcomings as the medicine ball technique described above, namely the lack of an element of surprise, and the absence of a realistic simulation of a cut-block.

As such, there exists a need for a training device which mimics the movement of a football player executing a cut-block maneuver.

SUMMARY OF THE INVENTION

The present invention provides a sports training apparatus which enables the user to accurately simulate the football maneuver known as the 'cut-block.' The present invention comprises a track, a rolling cart fitted to the track, an upright blocking pillar connected to the cart, and a triggering system for lowering and raising the blocking pillar at specified intervals in order to simulate the cut-block maneuver. The present invention additionally includes a stopping mechanism for stopping the movement of the cart.

DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

The present invention provides a sports training apparatus which enables the user to accurately simulate the football maneuver known as the 'cut-block.' The present invention comprises a track, a rolling cart fitted to the track, an upright blocking pillar connected to the cart, and a triggering system for lowering and raising the blocking pillar at specified intervals in order to simulate the cut-block maneuver. The present invention additionally includes a stopping mechanism for stopping the movement of the cart.

Figure 1:
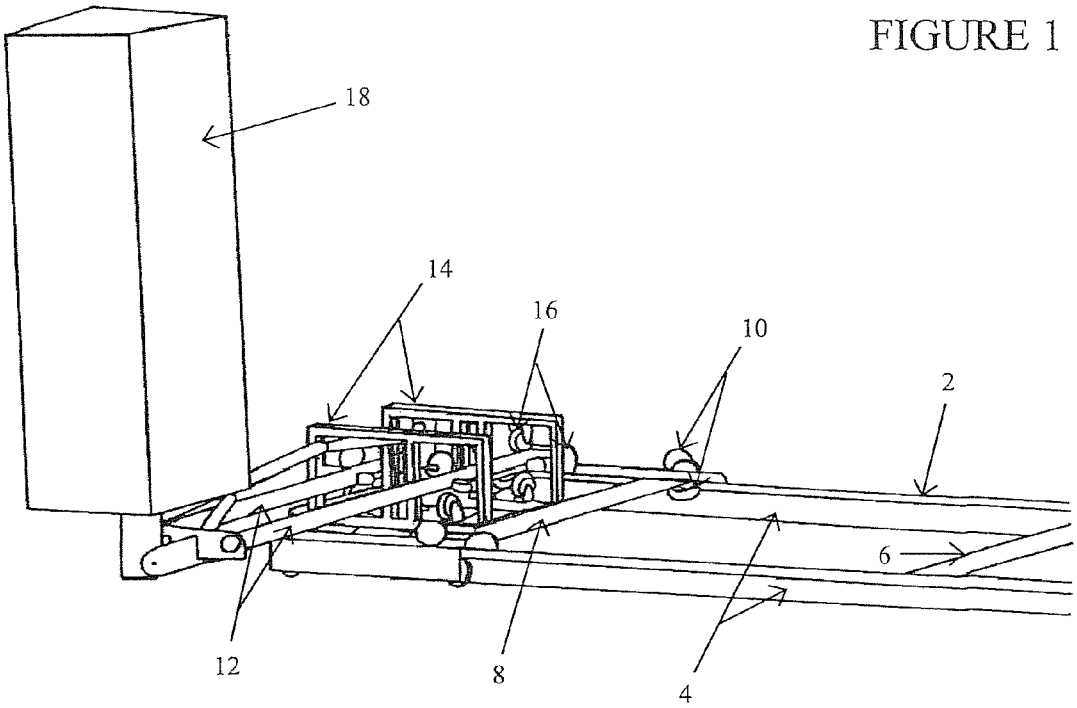
FIG. 1 represents a visual depiction of the present invention.

FIG. 1 presents a visual depiction of the present invention. The present invention includes a track (2) which allows the cart (8) of the present invention to travel along it. In the preferred embodiment a 20 foot track is used, though it should be understood that the present invention can be modified to include a longer or shorter track, as needed. The track of the present invention is preferably constructed from two parallel angle-iron lengths (4) connected by cross supports (6).

Figure 2:
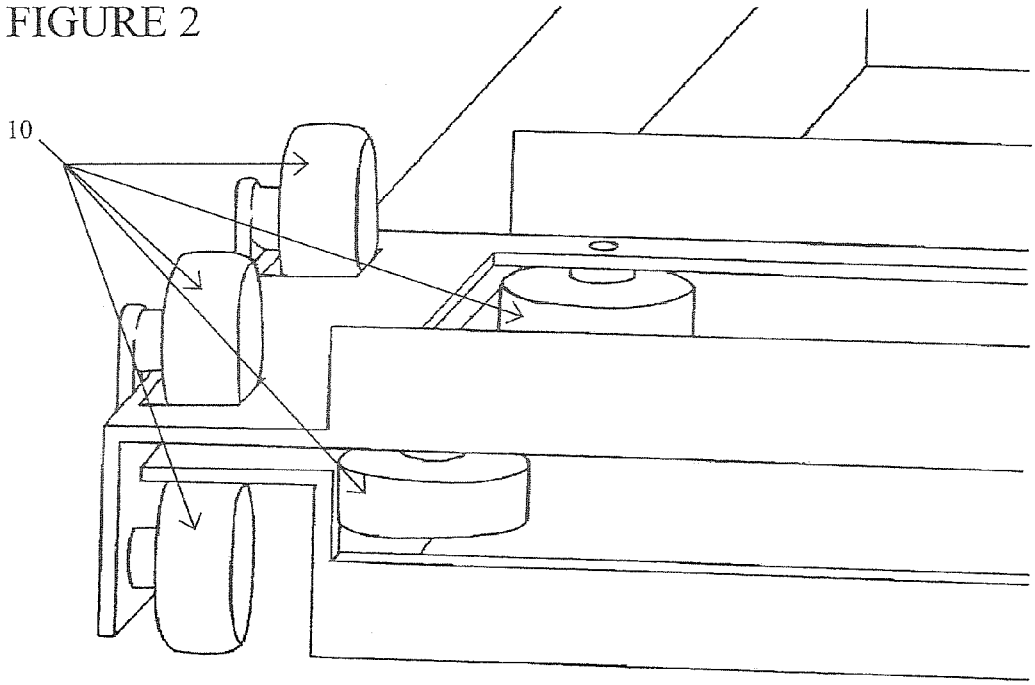
FIG. 2 represents a visual depiction of the arrangement of the guide-wheels of the cart of the present invention.

The present invention further includes a cart (8) which travels along the track, such as when being pushed by a football player during a blocking drill. Connected to the cart are guide-wheels (10), which allow the cart to move smoothly along the track. Preferably, the guide-wheels are distributed in groups of three in each of the four corners of the cart, in the manner depicted in FIG. 2. The lower and inner guide wheels are preferably mounted using pin axles. In the preferred embodiment, a clearance of approximately 1/16" is left to allow for proper movement of the wheels.

Figure 3A:
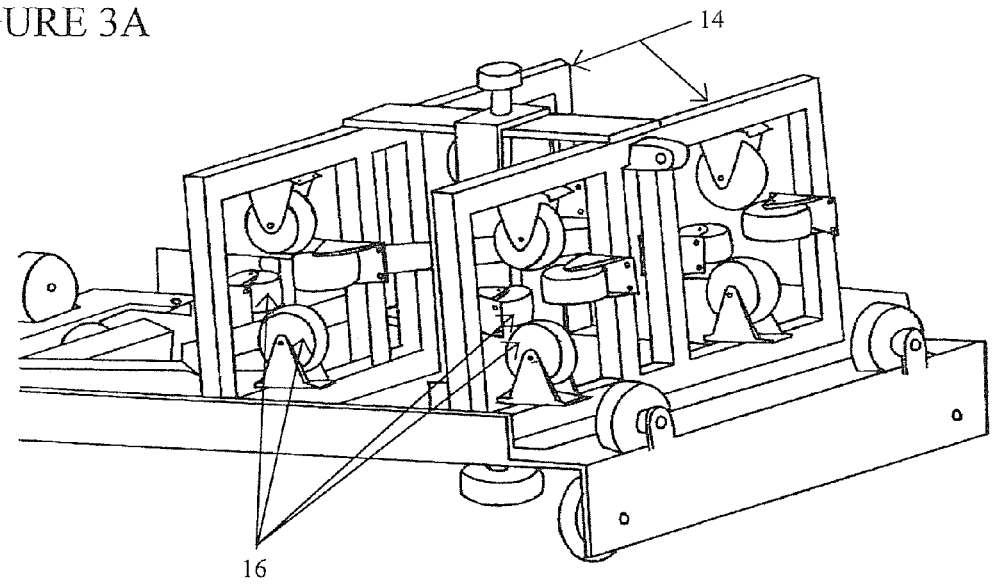
FIG. 3 represents a visual depiction of: (A) an angled view of the caster frames without the parallel pipes; (B) and end view of the caster frames without the parallel pipes; (C) a view of the caster frames of the present invention fully assembled with the parallel pipes; and (D) a depiction of the location of the end plate of the triggering system of the present invention.
Figure 3B:
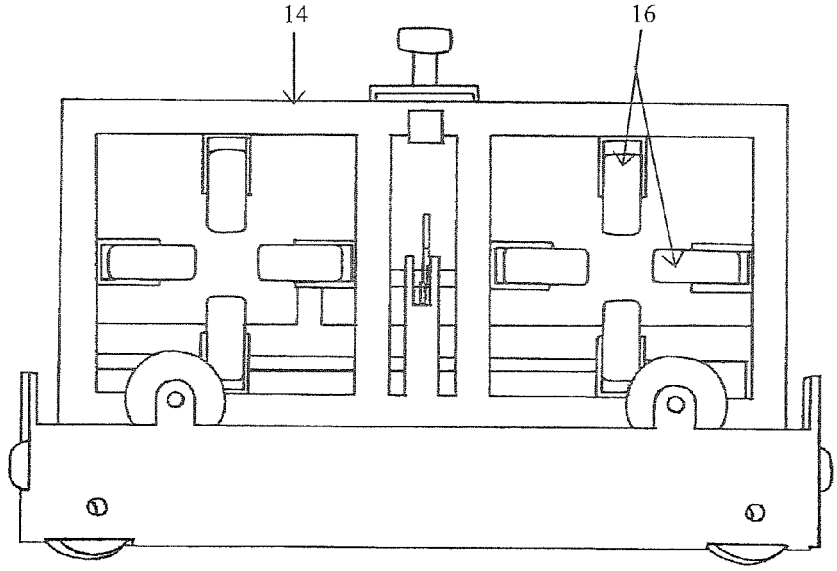
Figure 3C:
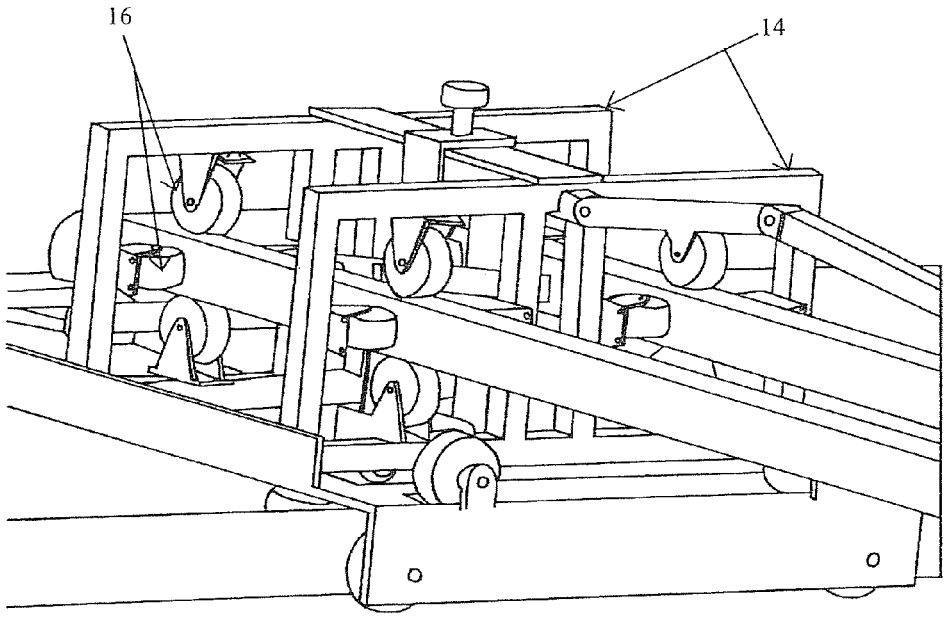
Figure 3D:
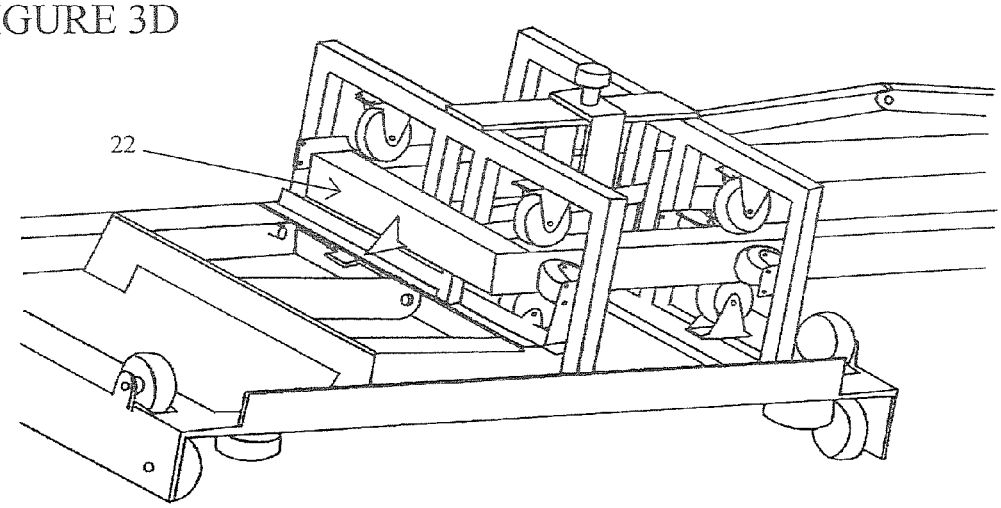

In the preferred embodiment of the present invention, connected to the cart are two parallel pipes (12) which allow for the triggering system to adjust the position of the blocking pillar when the present invention is in use. While in the preferred embodiment the parallel pipes are square shaped (as depicted in FIG. 3C), the present invention can alternatively be embodied using differently shaped pipes (such as circular pipes). Surrounding the pipes are two steel frames (14) which contain caster wheels (16) placed around the pipes to allow linear motion of the frames along the pipes. There are preferably two sets of four casters on each pipe that were spaced about 1 foot apart, as depicted in FIGS. 3A-3C. For the sake of clarity, FIGS. 3A and 3B depict the steel frames (14) including caster wheels (16) of the present invention when not engaged with the parallel pipes of the present invention, while FIG. 3C depicts the steel frames of the present invention when engaged with the parallel pipes. In order to allow the caster wheels the proper spacing, 1/16 inch spacers are preferably included on each wheel. A threaded end cap is also preferably included on the end of each of the pipes, to which is connected the end plate (22) (between the two pipes), the location of which is depicted in FIG. 3D. The end plate serves to provide permanent spacing between the tubing in order to maintain the tubes' parallel orientation and to prevent them from flexing. Additionally, the end plate functions as a locking point for the triggering system of the present invention. This end plate is where the trigger holds the pad in the set position.

Figure 4A:
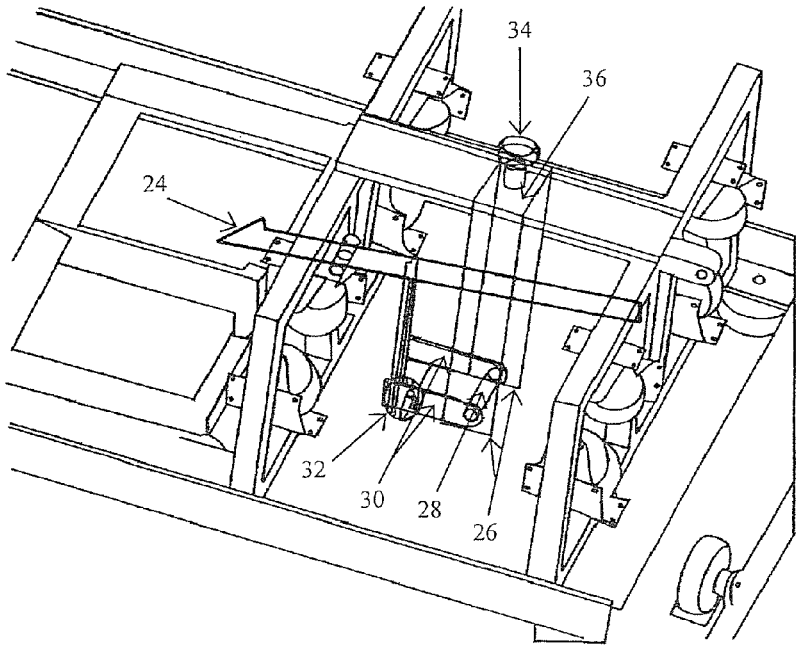
FIG. 4 represents a visual depiction of: (A) the triggering system of the present invention; (B) the triggering system prior to being triggered; (C) the triggering system of the present invention in a mid-trigger state; and (D) the triggering system of the present invention after being triggered.

FIG. 4A depicts the triggering system of the present invention which serves to raise and lower the blocking pillar of the present invention at defined intervals. In the preferred embodiment, the triggering system uses a stationary lever (24) that pivots on a bolt and holds the springs back by holding the end plate. In the preferred embodiment, the end of the stationary lever is pointed to serve as a truss-type trigger. The triggering system then frames but does not touch the stationary lever with two vertical bars (26), preferably pieces of three-sixteenths inch by one-and-a-half inch flat stock. The vertical bars are joined at their bottoms using a mounting shaft (28) (preferably three-eighths inch). Two short horizontal arms (30), preferably three inches long, are also connected to the mounting shaft, and a wheel (32) is preferably welded under the shaft. There is also a piece of three-sixteenth inch by one-and-a-half inch flat stock sticking up that is slotted around the stationary lever arm. When the wheel hits a trigger spot, the wheel, arms, and flat stock rises up by pivoting around the bottom shaft thereby pushing the lever (24) up which then releases the end plate and allows the springs to pull the linkage apparatus through the guide wheels thus completing the cycle. All of the above-mentioned components are connected below a mini track/cart system (36) which allows the manual selection of which of several trigger spots the system will trigger. The cart has a spring loaded selector knob (34) which when pulled up by the operator will allow the triggering system to slide to the desired hole where the selector knob then can be released.

Figure 4B:
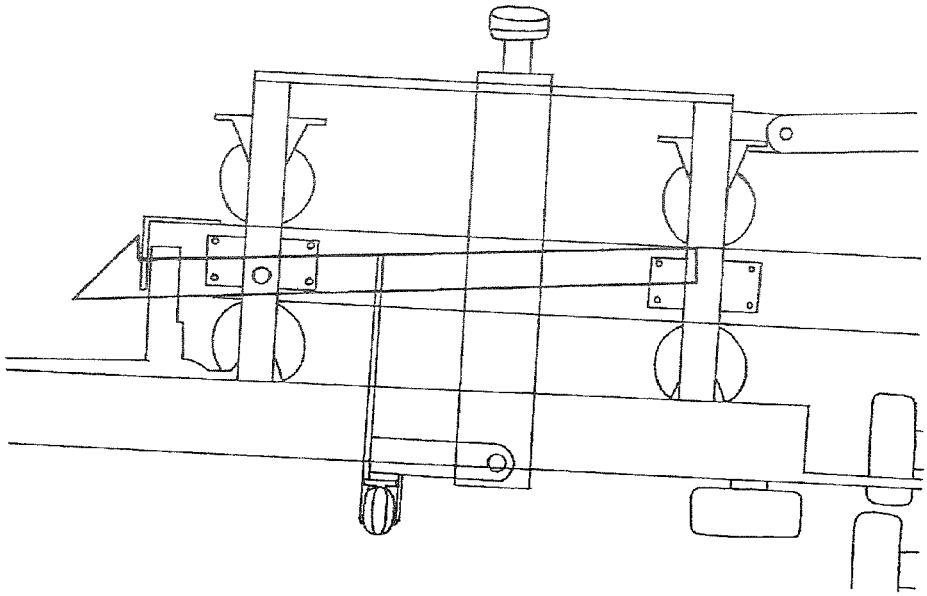
Figure 4C:
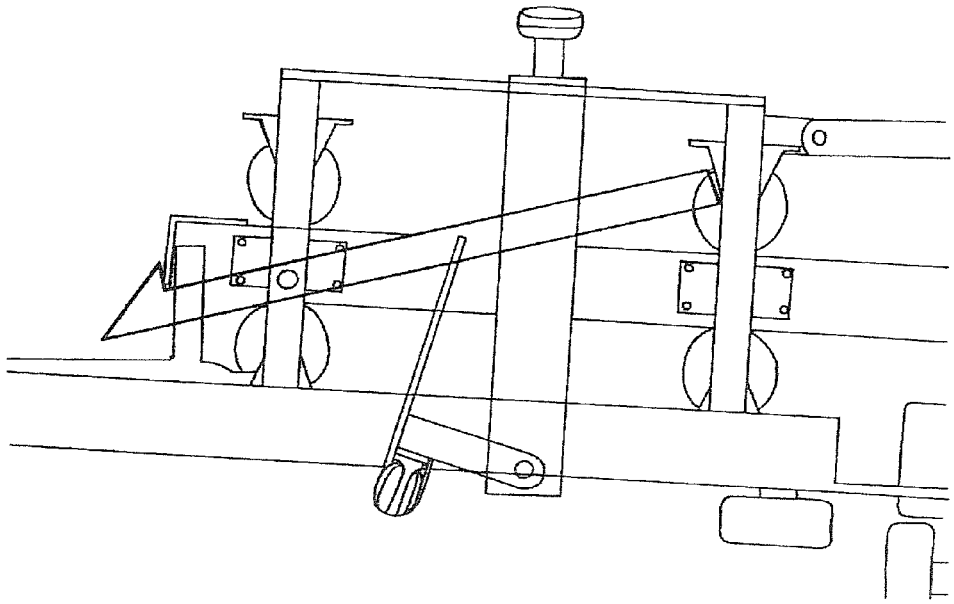
Figure 4D:
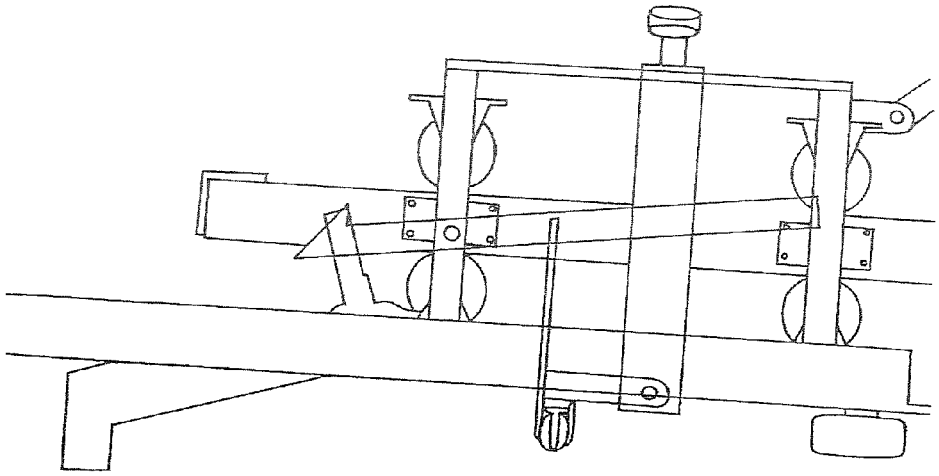

FIGS. 4B-4D depicts the operation of the triggering system of the present invention, including the movements of the various elements of the triggering system during its operation. FIG. 4B depicts the triggering system prior to being triggered, FIG. 4C depicts the triggering system in mid-trigger, and FIG. 4D depicts the triggering system after being triggered.

Figure 6:
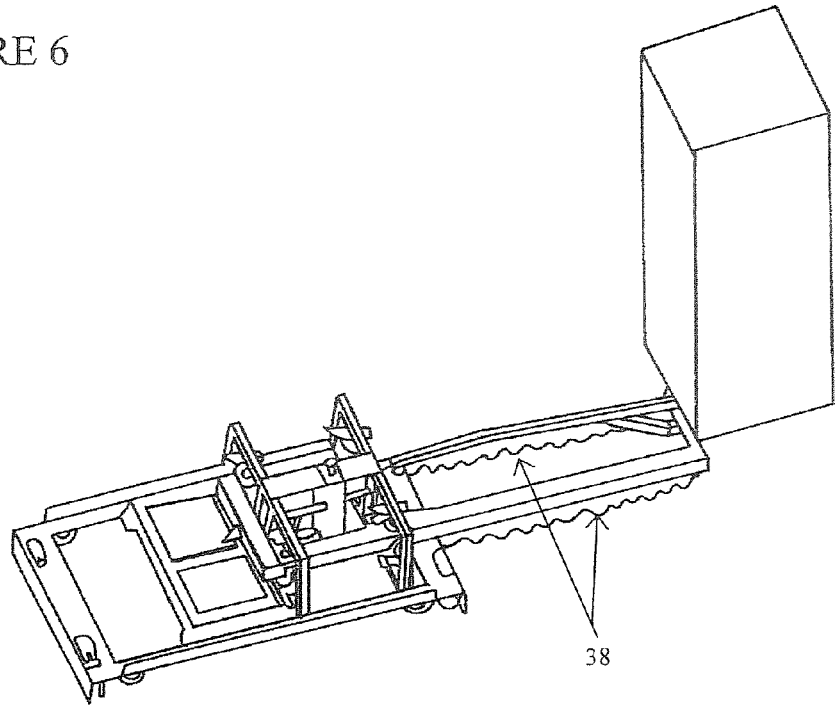
FIG. 6 represents a visual depiction of the location of the springs of the present invention.

The present invention additionally incorporates springs (38) that are preferably mounted to turnbuckles that are welded to the inside of the lower support for the pad at the end of the pipes, as depicted in FIG. 6. The preferred embodiment of the present invention implements a dual stage spring system consisting of a heavy spring and a weaker spring. The heavy spring provides the initial quick movement and is not in tension when the pad is all the way down. The weaker spring aides in the speed of the sled and is in tension in all positions. This set up allows for easy trigger reset because in the preferred embodiment the large spring does not start pulling until the pad is nearly twenty degrees.

Figure 7A:
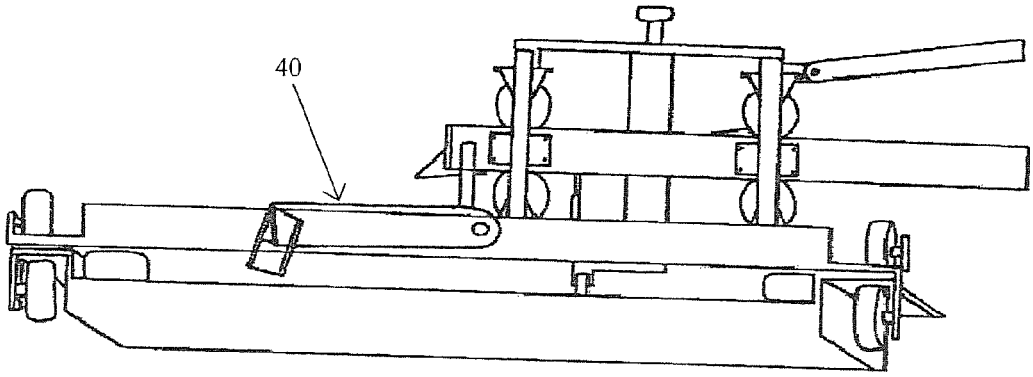
FIGS. 7A and 7B represent a visual depiction of the stopping mechanism of the present invention, as well as its orientation and placement within the structure of the present invention.
Figure 7B:
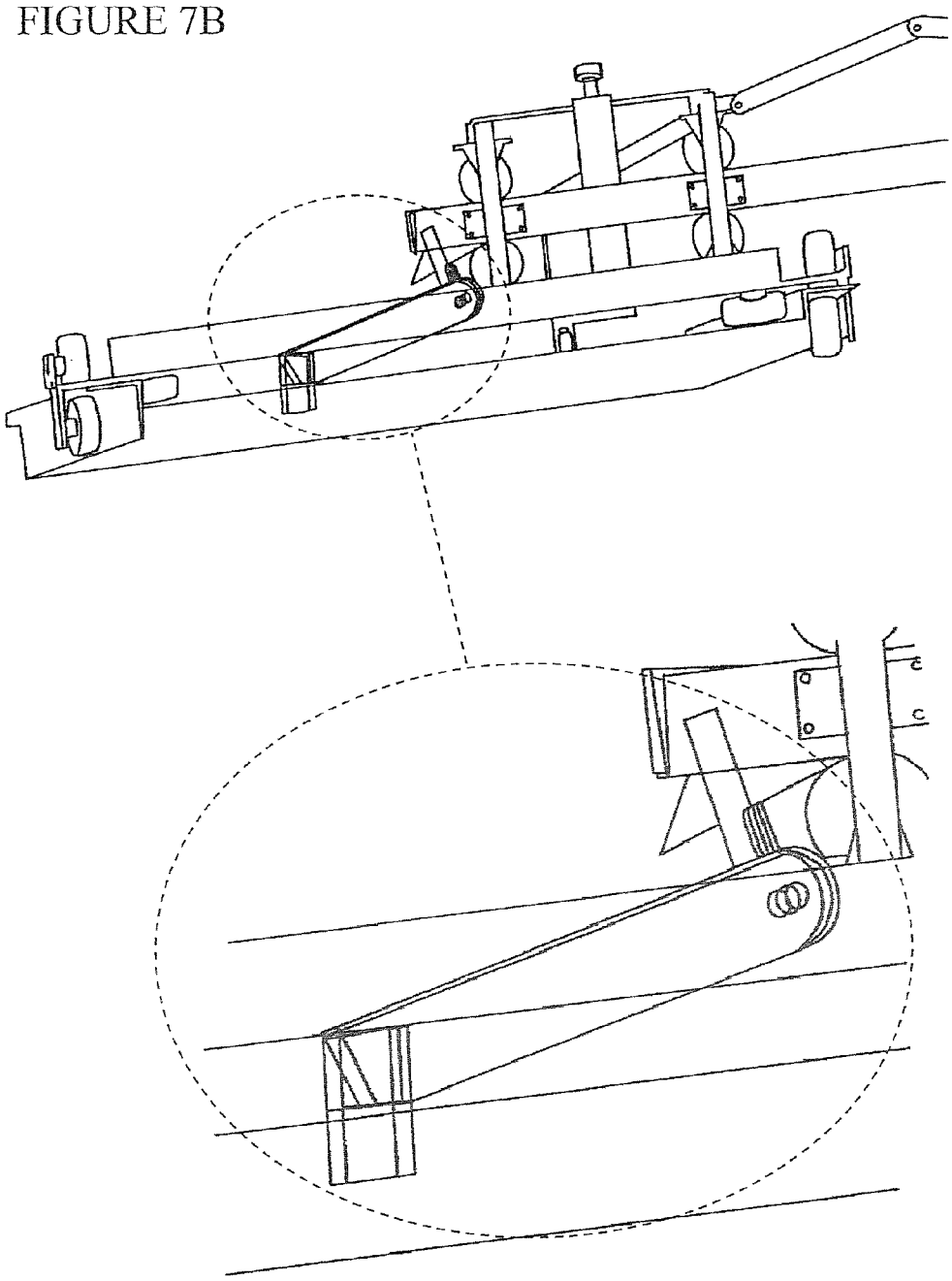

FIGS. 7A and 7B depict the stopping mechanism (40) of the present invention. The stopping mechanism is a lever-type device that is engaged and disengaged by the end plate (22), and functions to stop the cart of the present invention. The stopping mechanism preferably includes a 4 inch vertical piece on the cross piece of the stopping mechanism which strikes against the inner side of the end plate. FIG. 7A depicts the stopping mechanism in the disengaged state, when the sled is in the set position and the stopping mechanism is raised up. In the preferred embodiment, once the end plate (22) moves, the stopping mechanism lowers into the engaged position, depicted in FIG. 7B. In the preferred embodiment the stopping mechanism is constructed to be the same width as the inner part of the cart and has two parallel members that are connected by a solid member an have a leg protruding one inch below on each side. Additionally, two diagonal members attach the stopping mechanism to the cart using a pivot pin. When the stopping mechanism is engaged, as depicted in FIG. 7B, it drops down onto one of the cross supports (6) of the track, thereby causing the cart to stop.

In the preferred embodiment, the blocking pillar (18) is essentially constructed to include a frame constructed of 1" angle iron and face it with ¼" plywood. 2" foam was then be applied to the plywood to give it its padding. It should be understood that in alternative embodiments, other blocking pillars and dummies may be used as well.

Figure 5:
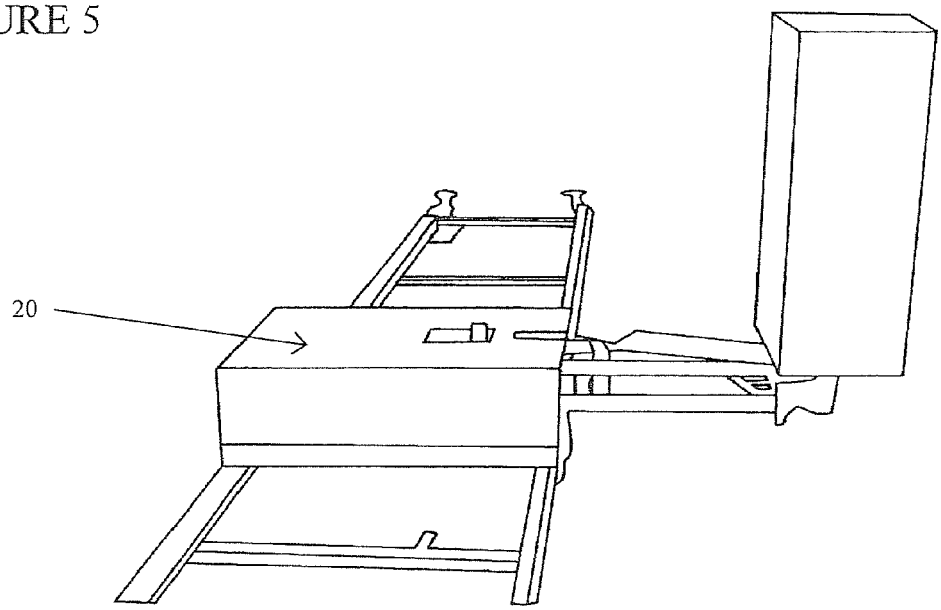
FIG. 5 represents a visual depiction of the protective metal casing of the present invention.

Additionally, as depicted in FIG. 5, the present invention includes a protective metal casing (20) which serves both to protect users from the cart's moving parts, and also to protect the cart from exposure to outdoor elements.

Obviously, many modifications and variations of the present invention are possible in light of the above teachings. It is, therefore, to be understood that within the scope of the appended claims, the invention may be practiced otherwise than as specifically described.

What is claimed is:

1. A sports training apparatus comprising:

a track, a cart fitted to said track and rollable along said track, a blocking pillar connected to said cart, tension means for storing force, said tension means being operatively connected to said cart and said blocking pillar, said blocking pillar being lowered by force released by said tension means, and a triggering system for lowering said blocking pillar at specified intervals as said cart travels rolls along said track, wherein said triggering system includes a lever pivotably mounted upon said cart, said lever being operatively engaged to said tension means and operable to regulate the tension of said tension means, said lever being pivotable between a pre-trigger condition wherein said tension means is tensioned and said blocking pillar is in an upright position, and a trigger position, wherein said tension means releases force to lower said blocking pillar, and at least one trigger spot situated so as to cause said lever to pivot from said pre-trigger position to said trigger position when said cart rolls over said at least one trigger spot.

2. The training apparatus of claim 1, wherein said track is defined as a plurality of parallel metal beams.

3. The training apparatus of claim 2, wherein said parallel beams are operatively connected by a plurality of linking beams oriented perpendicularly to said parallel beams.

4. The training apparatus of claim 1, wherein said rolling cart includes a plurality of wheels for rolling the cart along said track.

5. The training apparatus of claim 4, wherein said wheels are oriented along said track.

6. The training apparatus of claim 1, wherein said blocking pillar is defined as an elongated, padded blocking dummy.

7. The training apparatus of claim 1, wherein said triggering system includes a selection mechanism for adjusting the triggering system's operation.

8. The training apparatus of claim 1, further including a stopping mechanism for stopping the movement of said cart.

9. A sports training apparatus according to claim 1, wherein said blocking pillar is further defined as being situated upon a lower support, said tension means is further defined as at least one spring operatively connected to said cart and to said lower support, and said blocking pillar is lowered by force released by said spring upon said lower support.

* * * * *